United States Patent [19]

Marinelli

[11] Patent Number: 4,480,718

[45] Date of Patent: Nov. 6, 1984

[54] ENGINE LUBRICATING OIL LEVEL REGULATOR AND REPLENISH OIL WARNING SYSTEM

[76] Inventor: Ralph Marinelli, 2825 Vinsetta, Royal Oak, Mich. 48073

[21] Appl. No.: 391,943

[22] Filed: Jun. 24, 1982

[51] Int. Cl.[3] ..... F01M 11/12

[52] U.S. Cl. ..... 184/103 R; 33/126.7 R; 184/105 R; 184/1.5

[58] Field of Search ..... 184/103 R, 105 R, 1.5; 33/126.7 R

[56] References Cited

U.S. PATENT DOCUMENTS

| | | | |
|---|---|---|---|
| 1,465,167 | 8/1923 | Miller | 184/103 R |
| 1,503,334 | 7/1924 | Norris | 184/103 R |
| 1,600,405 | 9/1926 | Dudley | 184/103 R |
| 1,776,942 | 9/1930 | Deutsch | 33/126.7 R |
| 1,972,962 | 9/1934 | Weber | 184/103 R |
| 2,564,230 | 8/1951 | Pitney | 184/103 R X |
| 3,712,420 | 1/1973 | Pelizzoni et al. | 184/103 R |
| 4,299,307 | 11/1981 | Scott | 184/1.5 X |

FOREIGN PATENT DOCUMENTS

| | | | |
|---|---|---|---|
| 1195551 | 6/1965 | Fed. Rep. of Germany | 184/103 R |
| 535871 | 2/1922 | France | 184/103 R |
| 1041617 | 1/1955 | France | 184/103 R |
| 518421 | 2/1940 | United Kingdom | 184/103 R |
| 1053058 | 12/1960 | United Kingdom | 33/126.7 R |
| 2017917 | 10/1979 | United Kingdom | 103 R/ |

*Primary Examiner*—David H. Brown
*Attorney, Agent, or Firm*—Robert G. Mentag

[57] ABSTRACT

A lubricating oil level regulator and replenish oil warning system for use with an apparatus having an oil sump with a dipstick tube, such as an engine, a stationary machine or the like. The oil level regulator system includes an air-sealed lubricating oil reservoir adapted to be disposed above the level of the oil in an oil sump, and at least two elongated sloping tubes having their upper ends attached to the oil reservoir and their lower ends extended through the dipstick tubes into the oil sump. The lower ends of the two sloping tubes are disposed at the functional oil level, and means is provided for sealing the elongated sloping tubes in the dipstick tube.

8 Claims, 7 Drawing Figures

10
11
12
13
13a
13b
14
15
16
17
24
26
27
28
29
30
31
32
33
34
34a
35
36
37
38
39
40
41
42
43
44
45
46
47
48
49
50

ENGINE LUBRICATING OIL LEVEL REGULATOR AND REPLENISH OIL WARNING SYSTEM

TECHNICAL FIELD

This invention relates generally to gravity induced flow liquid level regulators, and more particularly to a gravity operated engine lubricating oil level regulator and replenish oil warning system. The engine lubricating oil level regulator and replenish oil level warning system automatically maintains the engine lubricating oil at the full level throughout the operating life of an engine, and it warns the operator of the engine of incipient loss of engine lubricating oil.

BACKGROUND ART

It is known in the lubrication art to provide various types of controls for maintaining a liquid level in an engine reservoir or sump. However, the aforedescribed prior art devices are quite complex, and the installation thereof, in many instances, requires extensive engine modifications. Many of the prior art engine lubricating oil level regulators and replenish oil indicators are also costly, and they have no after market potential. Examples of prior art engine lubricating oil level regulators which incorporate costly and complex structures, and wherein the engine may require modifications for its use, are shown and described in U.S. Pat. Nos. 2,564,231; 2,792,912; 3,570,629; 3,712,420; 4,103,665 and 4,108,201.

DISCLOSURE OF THE INVENTION

In accordance with the present invention, an engine lubricating oil level regulator and replenish oil warning system is provided which comprises an oil reservoir and a multi-tube assembly for regulating oil delivery to an engine oil sump or pan. The oil reservoir is equipment with a sight tube for direct observation of the oil level in the reservoir, and an oil level sensor and signal system to alert the operator of the vehicle in which the invention is mounted as to the need to replenish the oil in the reservoir. The reservoir has a filler neck adapted to be closed by a suitable filler cap, which also carries an oil can opener, that functions as a tightening arm as well as a handy opener. The reservoir filler neck may be provided with a screen. The oil reservoir is adapted to be mounted in a convenient place under the engine hood, and in a position adjacent the engine and above the level of the engine dipstick tube.

The multi-tube assembly connects the bottom of the oil reservoir to the engine oil pan or sump through the conventional dipstick tube. The tubes in the multi-tube assembly slope downwardly along their lengths and terminate at the functional oil level, which is the level to which the engine oil falls in the oil pan or sump when the engine operates. The tubes in the multi-tube assembly must be at least one quarter of an inch apart at the reservoir end thereof to prevent interference between air and oil flow therethrough. The upper part of each of the tubes is preferably made of a transparent, flexible plastic, while the lower part of each tube, which protrudes into the oil pan, is made of copper. The copper tubes are provided with a clamp to fix the position of the tubes in the dipstick tube, and to provide a seal to accommodate the positive crankcase ventilation system.

The multi-tube assembly is provided with a handle and an improved measuring scale so that the tube assembly may be used as a conventional dipstick. The low level warning system senses oil comsumption while the engine is operated by monitoring the functional oil level and simultaneously supplying make-up oil to keep the engine full of oil. The engine lubricating oil level regulator and replenish oil warning system may also be employed to automatically control lubrication levels in production machinery and other power devices which incorporate lubricating oil sumps.

The engine lubrication oil level regulator and replenish oil warning system of the present invention conserves oil, and it prevents overfilling of engine oil.

BEST MODE OF CARRYING OUT THE INVENTION

Figures 1, 2, 5:
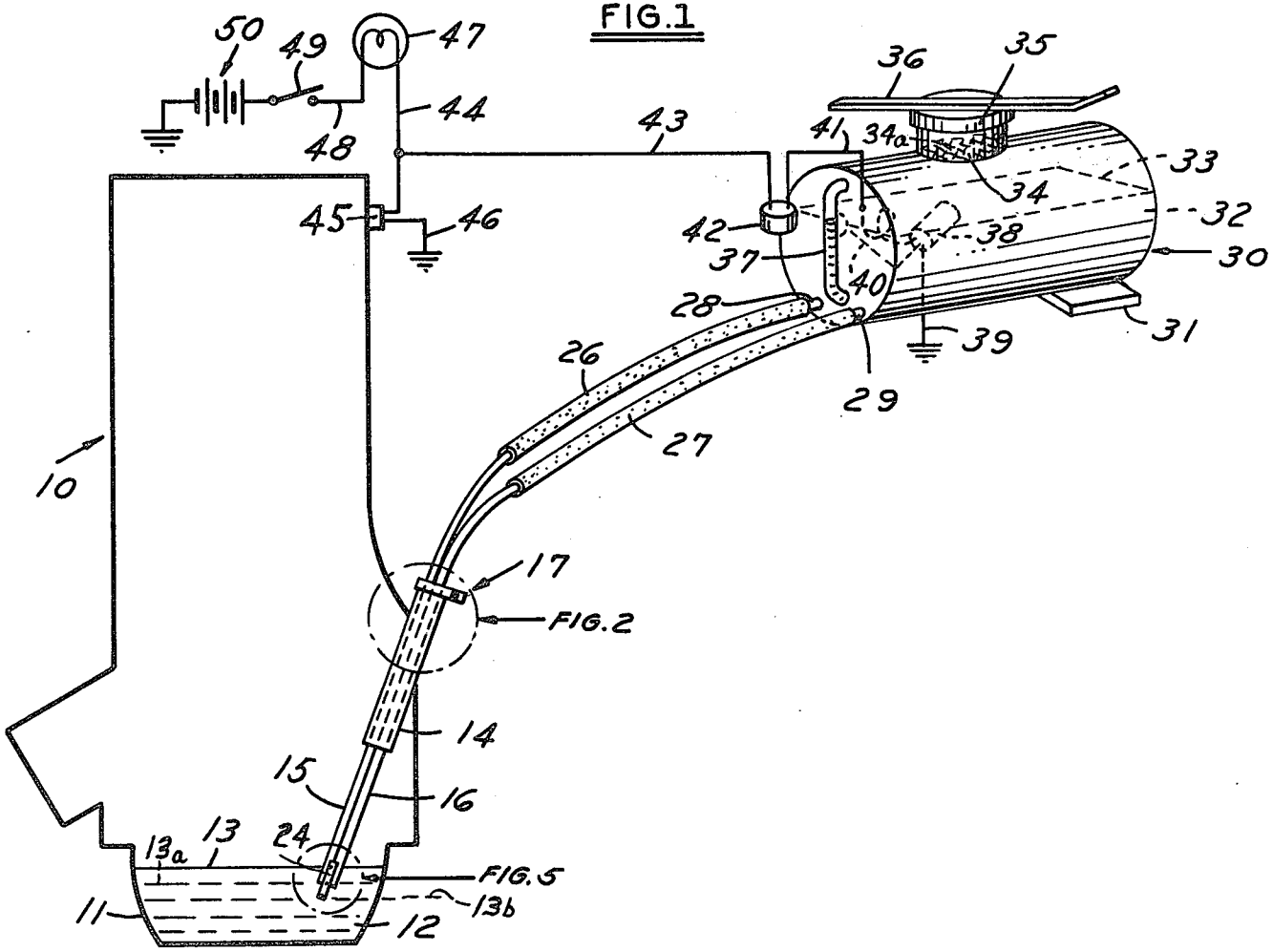
FIG. 1 is a schematic view of a cross section of an internal combustion engine and a perspective view of an engine lubricating oil level regulator and replenish oil level warning system operatively mounted on said engine in accordance with the principles of the present invention.
FIG. 2 is a fragmentary, enlarged elevational section view of the upper end of the engine dipstick tube illustrated in FIG. 1, taken within the circle marked 2 of FIG. 1, and the multi-tube assembly of the present invention mounted in said dipstick tube.
FIG. 5 is a fragmentary view of the lower end of the multi-tube assembly of the present invention, taken within the circle marked FIG. 5 of FIG. 1, and showing an improved dipstick scale mounted on the lower end of the multi-tube assembly.
Figure 2:
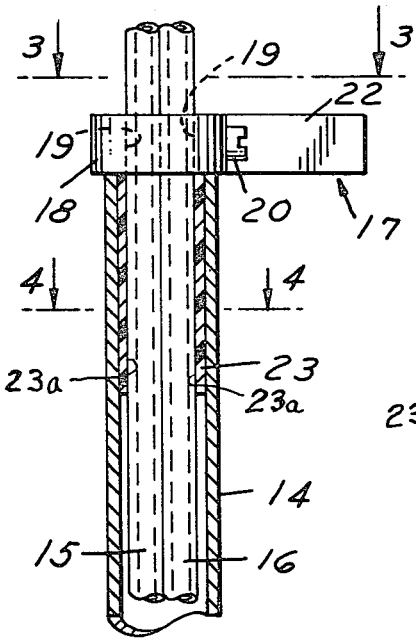

Referring now to the drawings and in particular to FIG. 1, the numeral 10 generally designates a schematic cross section view of an internal combustion engine on which the invention is mounted for illustration purposes. The numeral 11 designates the usual engine lubrication oil pan or sump. The numeral 12 designates the lubricating oil in the engine sump 11, and the top level of the oil 12 is indicated by the numeral 13. The oil level 13 is the full level of the oil 12 in the sump 11 when the engine 10 is not operating. When the engine 10 is operating, the full oil level is designated by the numeral 13*a*.

The numeral 14 in FIG. 1 designates the usual dip stick tube which is mounted in the side of an internal combustion engine for slidably supporting a conventional dip stick, which is used for checking the level of the lubricating oil in the engine pan or sump 11.

Figure 3:
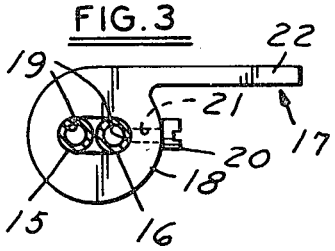
FIG. 3 is a horizontal view, partly in section, of the structure illustrated in FIG. 2, taken along the line 3—3 thereof, and looking in the direction of the arrows.
Figure 4:
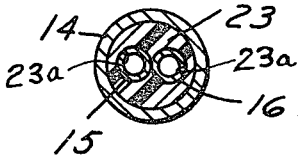
FIG. 4 is a horizontal, section view of the structure illustrated in FIG. 2, taken along the line 4—4 thereof, and looking in the direction of the arrows.

As shown in FIG. 1 and 2, the dipstick tube 4 is adapted to have slidably mounted therein a multi-tube assembly made in accordance with the principles of the present invention, and which includes at least two tubes, such as copper tubes 15 and 16. As best seen in FIGS. 2 and 3, the two tubes 15 and 16 are held together at the upper end thereof by means of a suitable clamp, generally indicated by the numeral 17. As shown in FIGS. 1, 2 and 3, the clamp 17 is disposed around the copper tubes 15 and 16 adjacent the upper ends of the tubes 15 and 16. The clamp 17 includes a body portion 18 through which is formed an elongated tube slot, slightly larger than the diameter of the tubes 15 and 16, and which has curved longitudinal ends 19. The tubes 15 and 16 are releasably locked in the tube slot in the clamp body portion 18 in a desired operative position by a suitable lock screw 20. The lock screw 20 passes through a transverse threaded bore 21 in the body portion 18 so as to permit the inner end of the screw 20 to urge the tube 16 to the left, as viewed in FIG. 3, into locking engagement with the tube 15.

As shown in FIGS. 2 and 3, the clamp 17 is provided with a suitable handle 22 for lifting the tubes 15 and 16 upwardly to remove them from the dipstick tube 14. As shown in FIGS. 2 and 3, a cylindrical crankcase seal member 23 is provided with a pair of suitable longitudinal holes 23*a* through which are mounted the copper tubes 15 and 16. As shown in FIG. 2, the outer circular surface of the seal member 23 sealingly engages the inner periphery of the bore in the crankcase tube 14. As shown in FIG. 2, when the tubes 15 and 16 and the seal member 23 are mounted in the crankcase tube 14, the lower end of the clamp 17 seats on the upper outer end of the crankcase tube 14 and determines the position of the lower ends of the tubes 15 and 16 at the functional oil level 13*a*. In one embodiment, each of the copper tubes 15 and 16 had an inner diameter of approximately 0.1", with an outer diameter of approximately 0.125".

Figure 6:
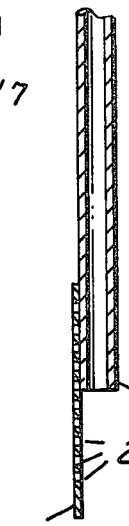
FIG. 6 is an elevational section view of the multi-tube assembly illustrated in FIG. 5, taken along the line 6—6 thereof, and looking in the direction of the arrows.
Figure 5:
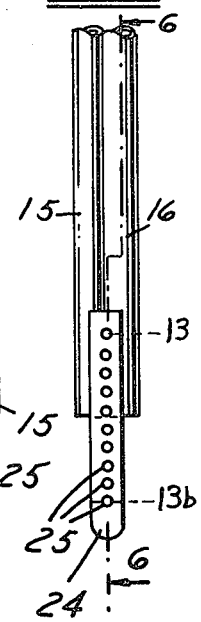

As shown in FIGS. 5 and 6, a dipstick scale 24 is fixedly mounted, as by a suitable adhesive, on the lower end of the tubes 15 and 16. The dipstick scale 24 is provided with a plurality of evenly spaced holes 25 which create oil film windows to indicate the oil level in the crankcase or sump 12. When the oil level in the sump falls down to the lowest hole 25, the oil level is at a point where oil has to be added to the engine. If the oil level reaches the upper hole 25, then such a situation indicates that the engine sump 12 is at the full level with the engine not running. The dipstick 24 obviates the need for a rag or other means for wiping the dipstick before taking a reading. All that is required is that the dipstick be flicked with the wrist or tapped against the engine to break the oil film windows in holes 25 and then reinserted to take the oil level measurement.

As shown in FIG. 1, the upper ends of the copper tubes 15 and 16 extend outwardly from the side of the engine, and they are adapted to have slidably mounted thereover the front ends of a pair of mating flexible, transparent, plastic tubes 26 and 27, respectively. The transparent tubes 26 and 27 have an appoximately inner diameter of 0.25". The rear ends of the flexible tubes 26 and 27 are slidably mounted over tubes 28 and 29, respectively, which are connected to an air-sealed oil reservoir, generally indicated by the numeral 30. The reservoir 30 is provided with a fixedly mounted plate 31 which is adapted to be attached to a vehicle in a position adjacent the engine 10. The numeral 32 designates the reserve oil in the reservoir 30, and the numeral 33 designates the level of the oil 32 in the tank 31.

The oil reservoir or tank 30 is provided with a filler tube or neck 34, which is adapted to be enclosed by a suitable cap 35 that is provided with a fixedly mounted can opener 36. The can opener 36 also functions as a handy tightening arm for tightening the cap 35 in position on the filler neck 34. The filler neck 34 may be provided with a suitable dirt screen 34*a*.

As shown in FIG. 1, the oil reservoir or tank 30 has a sight tube 37 to permit the operator to visually check the level of the oil in the reservoir 30. The reservoir 30 is an air-sealed reservoir. A float 38 is mounted in the reservoir 30 by an operative arm 40. The float 38 carries a mercury switch which closes when the present replenish oil level in the reservoir is reached grounding to 39 the usual low pressure warning system (Nos. 50, 49, 48, 47, 44, 45, 46) through flasher unit 42. This causes the usual low pressure indicating lamp 47 to flash on and off to indicate that oil must be added to the reservoir.

This shared use of the usual low oil pressure indicating lamp does not interfere with the working or reliability of the usual low pressure warning system. By simply adding wire 43, flasher unit 42 and the float actuated mercury switch 38, the usual low pressure warning lamp is used to serve two functions. As a steady light, it indicates low oil pressure in the usual way. As a flashing light, it indicates that oil must be added to the oil reservoir. The low pressure mode will override the replenish oil mode. A 300 hour flashing test (12,000 miles for one year at average 40 m. p. h.) on lamp 47 was conducted on a ten year old lamp (1971 Volvo) during 1980–1981, and the lamp is still performing.

Figure 7:
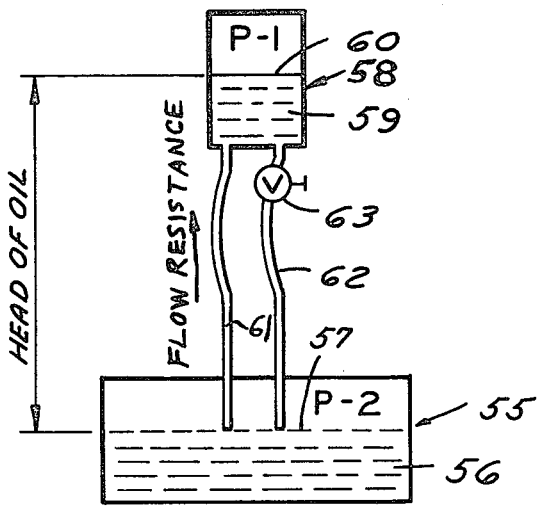
FIG. 7 is a schematic view of an engine oil sump or pan and the oil level regulator system of the present invention to show the operation of the invention.

FIG. 7 illustrates the principle of operation of the oil regulator system of the present invention. The numeral 55 designates an engine oil sump of oil pan in which is lubricating oil 56. The numeral 57 designates the oil level in the engine oil sump 55 with the engine off. The numeral 58 designates the oil reservoir with oil 59 therein, and with an oil level 60 slightly below control level. Initially, oil will flow down through both tubes 61 and 62 at a decreasing rate, and drop into the oil sump 55. This last mentioned action will create a partial vacuum P-1 in the reservoir 58. The flow pattern then changes and oil continues to flow and drip out of one of the tubes 61 or 62, while air bubbles up through the other tube, 61 or 62, through a diminishing flow of oil coming down said other tube. After a few minutes, both tubes 61 and 62 become filled with oil, and the oil flow stops with no relationship to the oil level in the oil pan or sump 55. At the last mentioned point, the pressure P-2 in the oil sump 55, plus the flow resistance in the tubes 61 and 62, equals the pressure P-1 in the oil reservoir 58 plus the static pressure head of the oil 59 in the reservoir 58. Pressure P-1 in the reservoir 58 is thus sealed from the pressure P-2 in the oil pan or sump 55. The last described stable equilibrium seeking feature of the system serves to automatically stop oil delivery from the auxiliary tank or reservoir 58 when the vehicle carrying the engine 10 is parked on an incline with the engine off and exposing tube ends 61 and 62 to atmosphere.

The functional oil level is the level to which the oil falls in the oil pan 12 (FIG. 1) when the engine 10 is operated. It can be determined by starting a cold engine 10, and stopping it within one minute, and measuring the oil level by the dipstick 24 before the oil drains down from the engine 10. A practical approximation is the midpoint between the full and the add-oil marks on the dipstick 24.

When the engine 10 is started, heat and vibrations are generated which lower the flow resistance of the lubricating oil, and break up fluid films. The subtle force system which causes fluids to form into spheres creates a tendency for the oil to circulate through the tubes.

This force has a chance to be effective on the oil which becomes more sensitive in its less viscous, chaotic state. As a result, air can flow up one of the tubes 15 or 16 so as to allow oil to flow down the other tube 15 or 16. While the engine 10 operates, oil will continue to flow from the reservoir 30 down into the oil pan or sump 12 until the oil level in the oil sum 12 reaches the lower tips of the tubes 15 and 16, at the level 13*a* (FIG. 1). At this point, the air supply to the reservoir 30 is cut, and the delivery of oil from the reservoir 30 is stopped. Although the oil in the sump 12 is stabilized at the level 13*a*, oil continues to flow down one of the tubes 15 or 16, and up the other of the tubes 15 or 16, until the tubes 15 and 16 are filled with oil and the system is in equilibrium. This equilibrium is stable and is unaffected by engine heat and vibration while the tube ends are immersed in the oil. The oil in tubes 15 and 16 serves as an effective vacuum seal to keep the system turned off. The oil that flows up the tubes 15 and 16, at the aforementioned equilibrium point, is a sampling of the oil in the oil pan 12. Accordingly, an oil sample becomes available in the transparent tubes 26 and 27 to be readily seen for further inspection.

The ratio of oil delivery rates to oil consumption rates can be made close to a one-to-one ratio. By the use of multiple tubes and/or a flow control valve, such as the valve 63 in FIG. 7, the system may be made practically insensitive to the temporary loss of the true oil level reference when the vehicle travels up and down, over hilly terrain. This inherent insensitivity of the system to vehicle pitch and roll is further augmented by the location of the delivery or sensory tubes 15 and 16 in the dipstick, which tends to average out crankcase oil level.

The delivery rate of the oil from the reservoir 30 to the oil pan 12 is at a drop-by-drop rate. The fact that the delivery rate of the oil from the reservoir 30 is in the order of the consumption rate precludes the need for an interlocking shut-off valve, as valve 63 in FIG. 7, when the reservoir seal is broken to fill a partially filled reservoir 30. It will be understood that two or more of the tubes 15 and 16 may be used to interconnect the reservoir 30 with the oil pan 12.

An advantage of the present invention is that it provides a conveniently located, air-sealed oil storage reservoir 30 for lubricating oil 32, and which is connected to the oil pan 12 of the engine 10 with a plurality of tubes to maintain constant oil level in the oil pan 12, through the oil dipstick tube 14. The system senses oil consumption while the engine is operating by monitoring the functional oil level, and simultaneously supplying make-up oil to keep the engine 10 full of oil.

The liquid level regulator and replenish oil warning system of the present invention provides a replenish-oil alarm system which utilizes the usual low oil pressure lamp 47 to indicate when to add oil to ensure the availability of make-up oil to maintain the functional level in the crank-case and wherein additionally the flashing of the lamp 47 indicates the need to add oil because of the incipient loss of the functional oil level 13*a*. Accordingly, an alarm system for engine lubrication systems is provided which monitors a remote corresponding functional oil level in the reservior 30, instead of directly monitoring that level in the oil pan 12.

The liquid level regulator and replenish oil warning system of the present invention can be employed in engine powered vehicles, or in production machinery and other power devices which incorporate lubricating sumps so as to provide a control over the levels of oil in the lubricating sumps. The liquid level regulator and replenish oil warning system of the present invention includes an improved dipstick measurement scale to avoid overfilling in conventional lubricating oil systems. The improved dipstick scale 24 includes a plurality of evenly spaced apart holes or apertures 25 that are disposed between the full and add-oil marks 13 and 13*b* and beyond to indicate extent of overfilling on the dipstick scale 24. The dipstick scale 24 is adapted to be attached to the tubes 15 and 16 by any suitable means, as by a suitable adhesive. The oil film in the holes 25 reached by the oil level in the oil pan 12 stands out against the holes 25 with no oil film, so as to make the dipstick scale 24 much easier to read in bright or dim lighting and with dark or clear oils.

The liquid level regulator and replenish oil warning system of the present invention conserves oil. It has been found in actual tests that the invention has saved fifty percent of the oil normally consumed in city driving, and forty percent of that normally consumed in highway driving. These results were achieved by keeping the oil at the functional level in a test car during a test period versus normal operation from full to one quart low.

Most automobile engines are operated with less than their full capacity of oil, during most of the time of their operation. Heretofore, the Automobile Information Council found that fifty-six percent of automobiles operate at one or more quarts below the normal full level in the oil pan of the car. Furthermore, it is habitual with most motorists to wait until they are one quart low before adding oil. When engines are operated with less than their full capacity of lubricating oil, the lubricating oil becomes hotter and less viscous. This condition leads to increased oil losses from increased evaporation, and internal and external leakage. Tests in expressway driving have disclosed that the rate of oil consumption at the usual full level is 1.5 times that at the optimum level, and the consumption rate at one quart low is two times that at the optimum level.

The lubrication oil level regulator of the present invention makes it practical to determine the optimum full oil level for an engine, and to maintain the lubricating oil at that level. Most engines designate a full level in the oil pan that is above the optimum, and the engines are intended to be operated without adding oil until the oil level is one quart low, well below optimum level. Accordingly, the normal consumption of lubricating oil before refill straddles the actual undesignated optimum full mark on the conventional dipstick. At the optimum level, the oil consumption rate is lowest. The oil consumption rate is higher when the oil is above or below the optimum level. This can be readily understood by motorists who observe that the topmost oil in an engine oil pan is quickly consumed, and then there is a levelling off of oil consumption. However, not many motorists realize that after a further consumption of oil, the consumption rate increases again and engine lubrication deteriorates more rapidly than at the full level.

The liquid level regulator system of the present invention is particularly useful in extreme cold climates, where the effect of driving with low oil is especially critical. In military vehicles operating in extreme low temperatures, the lubricating oil used is of such low viscosity that operators are told that the vehicle engines may run out of oil before using a full tank of fuel.

The two major sources of error which cause people to overfill vehicle engines with oil are due to the fact that standard dipsticks are hard to read in marginal lighting, and that the standard dipsticks are usually read before the oil has drained down into the oil pan from the engine, or after the oil has drained out of the oil filter. The oil level regulator of the present invention prevents overfilling and underfilling of oil in a vehicle since the oil is not added directly to an engine but to a supply or reservoir tank which then feeds the lubricating oil to the engine oil pan as required. Overfilling of the oil pan in an engine contributes to fouled carburetors and plugs, and thereby to decreased gasoline mileage. Overfilling of oil in an engine oil pan also increases oil consumption and energy losses due to viscous drag. Overfilling of an engine oil pan also decreases the cooling and lubrication effect of the oil due to aeration effects.

Another advantage of the present invention is that it alerts the driver to the need to replenish oil, thereby optimizing the cost saving features of the invention, and providing a fail-safe alarm which is far more sensitive than the usual low pressure alarm to the loss of lubricant. The usual low pressure alarm is marginal as a safety precaution against loss of lubricant. The anticipatory feature of the replenish alarm system of the present invention is an advance warning system which precludes avoidable wear, as well as catastrophic failure.

The liquid level regulator and replenish oil warning system of the present invention extends engine life, improves engine performance and reduces the need for tuneups. It provides the optimum amount of oil to an engine throughout its life. This action assures the best lubrication inherent in an engine design. The invention replenishes new oil while the oil is being consumed. Accordingly, the oil retains it viscosity and coolant capacity. The oil additive situation is also improved since the new oil brings in new additives, and the increased oil capacity reduces the density of impurities.

A further advantage of the invention is that it conserves gasoline by virtue of all the aforedescribed preceding improvements because the optimum performance period of an engine is extended. An engine provided with the invention will get its best mileage over a longer period of time, as well as undergoing less drastic deterioration of its gasoline mileage. The liquid oil level regulator and auxiliary reservoir replenish oil warning system of the present invention extends cruising range of older vehicles, and vehicles operated in extremely cold climates.

The dipstick scale 24 may be used with conventional dipsticks by attaching the same to said dipsticks with a suitable adhesive. However, the dipstick scale 24, in such cases, would be mounted on a conventional dipstick with the top aperture or hole 25, which indicates full, at a point above the usual full line on the dipstick to measure amount of overfilling which is difficult to detect especially with clear fresh oil.

The oil level regulator system makes it practical for future engine designs to incorporate an optimum oil capacity and thereby decrease engine size, while prolonging life and peak performance. The device has a significant beneficial effect on the environment by decreasing the contamination of the atmosphere by vehicles. Approximately 50% reduction in the amount of lubricating oil actually processed through the engine into the atmosphere has been achieved on test vehicles.

The principle of operation is such that the force of gravity acts to deliver the oil and to create the vacuum which opposes it. In addition to the vacuum, the adhesive and cohesive forces working in the small bore tubes also oppose the action of gravity.

When the engine is not running, the system rapidly reaches static equilibrium. As the vacuum becomes stronger it retards flow until both tubes fill up with oil and the hydrostatic head of oil worked on by gravity is counterbalanced by the vacuum and the fluid friction forces at impending flow. This static equilibrium between gravity, and vacuum plus flow resistance, is sufficiently stable to prevent flow when the engine is not running. The advantage of this static equilibrium is that without active elements the system turns itself off when the vehicle is parked on an incline with the engine off.

When the engine is operated, its heat and vibration overcomes the flow resistance by making the oil less viscous and shaking loose the adhesive bonds between the oil and the tube. This action alone would not start flow because the system is basically symmetrical. An additional force system is active, namely, that which forms liquids into circular disks on a plane and spheres in the air. This force has an obvious circling quality and tends to cause fluids to rotate. In the structural configuration wherein the tube ends are close to each other in the reservoir, this tendency is reflected in a slight movement of liquid down one tube and up the other.

The upward flow is mixed with air, with the air/oil ratio increasing rapidly until pure air ascends the tube which destroys the vacuum and constitutes a full gravity supply system. When the functional level is reached, a mixture of air and oil ascend the tube until the tube delivers only oil and no air. Oil will continue down both tubes until the vacuum produced is sufficient to overcome the hydrostatic head worked on by gravity and the system stops delivering oil. As a result, atmospheric pressure is allowed to enhance the vacuum seal and the system is in dynamic balance. This stable equilibrium is not upset by an engine while running.

INDUSTRIAL APPLICABILITY

The liquid level regulator and replenish oil level warning system of the present invention is adapted for use with engines employed in movable vehicle, as well as in industrial stationary engines. It may also be used in other industrial machines wherein an oil pan or sump is employed for maintaining a proper supply of lubricating oil for such industrial machines.

I claim

1. An engine lubricating oil level regulator for use with an engine having a low oil pressure indicator lamp and an oil sump with a dipstick tube, characterized in that said regulator includes:

(a) an air-sealed lubricating oil reservoir disposed above the level of the oil in an oil sump;

(b) at least two elongated tubes, having their upper ends connected to said reservoir and their lower ends disposed through the dipstick tube of an engine and into the oil sump and having an inner diameter of approximately one-tenth of an inch;

(c) means for positioning and sealing said elongated tubes in the dipstick tube with their lower ends at the functional oil level in the oil sump; and, (d) means for filling the reservoir with oil, whereby the regulator senses oil consumption while the engine is operating by monitoring the functional oil level, and simultaneously supplying make-up oil through one of said two elongated tubes to the oil sump, in a drop-by-drop delivery rate which approximates the lubricating oil consumption rate of the engine, to maintain the functional oil level in the oil sump during operating of the engine, and wherein the regulator automatically provides an effective shut-off valve function when the reservoir is being replenished because of the low delivery rate when the partial vacuum in the reservoir is broken and when the engine is turned off because in the one-tenth of an inch inner diameter tubes there occurs an inherent balancing action between the weight and mass of the column of lubricating oil within the tubes and the cohesive forces of the oil in the tubes, and the vacuum in the reservoir, which all function to create a balance of forces and a steady state condition, and a valve-opening function when the engine is started up because of the engine vibratory forces and weight of the column of oil in the tubes are larger than the cohesive and vacuum forces so that downward flow from the reservoir is initiated when the tubes are exposed to the atmosphere in the oil sump.

2. An engine lubricating oil level regulator as defined in claim 1, characterized in that:

(a) said lubricator includes a replenish-oil alarm means operatively associated with said reservoir to monitor the oil level in the reservoir and provide a warning that additional oil is required to be placed in the reservoir by flashing the low oil pressure lamp "on" and "off".

3. An engine lubricating oil level regulator as defined in claim 2, characterized in that:

(a) said elongated tubes are provided with transparent sections adjacent the reservoir to provide a visual inspection of the oil in said tubes.

4. An engine lubricating oil level regulator as defined in claim 2, characterized in that:

(a) said reservoir is provided with a sight tube to show the level of oil in the reservoir.

5. An engine lubricating oil level regulator as defined in claim 2, characterized in that:

(a) at least one of said elongated tubes is provided with a flow control valve for controlling the flow of lubricating oil therethrough.

6. An engine lubricating oil level regulator as defined in claim 2, characterized in that:

(a) said means for positioning and sealing said elongated tubes in the dipstick tube is provided with a handle.

7. An engine lubricating oil level regulator as defined in claim 2, characterized in that:

(a) said elongated tubes are provided on the lower end thereof with a dipstick scale.

8. An engine lubricating oil level regulator as defined in claim 7, characterized in that:

(a) said dipstick scale is provided with a plurality of longitudinally and evenly spaced apart apertures for indicating the full level of lubricating oil in the oil sump, the add-oil level in the oil sump, levels in between said full level and the add-oil level, and levels beyond full level to measure overfills.

* * * * *